US005439348A

United States Patent [19]

Hughes et al.

[11] Patent Number: 5,439,348

[45] Date of Patent: Aug. 8, 1995

[54] TURBINE SHROUD SEGMENT INCLUDING A COATING LAYER HAVING VARYING THICKNESS

[75] Inventors: John H. Hughes, Manchester; David M. Nissley, Marlborough, both of Conn.; Kevin N. McCusker, Framingham, Mass.; Charles A. Ellis, Stuart, Fla.

[73] Assignee: United Technologies Corporation, Hartford, Conn.

[21] Appl. No.: 220,084

[22] Filed: Mar. 30, 1994

[51] Int. Cl.[6] ..... F01D 11/12

[52] U.S. Cl. ..... 415/173.4; 415/200; 29/889.2

[58] Field of Search ..... 415/170.1, 173.1, 173.4, 415/173.3, 200; 29/889.2

[56] References Cited

U.S. PATENT DOCUMENTS

| | | | |
|---|---|---|---|
| 3,365,172 | 1/1968 | McDonough et al. . | |
| 3,583,824 | 6/1971 | Smuland et al. | 415/117 |
| 4,013,376 | 3/1977 | Bisson et al. | 415/117 |
| 4,311,432 | 1/1982 | Kildea . | |
| 4,573,865 | 3/1986 | Hsia et al. . | |
| 4,573,866 | 3/1986 | Sandy, Jr. et al. | 415/116 |
| 4,650,394 | 3/1987 | Weidner . | |
| 4,650,395 | 3/1987 | Weidner | 415/116 |
| 4,655,044 | 4/1987 | Dierberger et al. | 60/753 X |
| 4,752,184 | 6/1988 | Liang . | |
| 4,759,687 | 7/1988 | Miraucourt et al. | 415/127 |
| 4,992,025 | 2/1991 | Stroud et al. . | |
| 5,088,888 | 2/1992 | Bobo | 415/170.1 |
| 5,165,847 | 11/1992 | Proctor et al. | 415/115 |
| 5,167,485 | 12/1992 | Starkweather . | |
| 5,169,287 | 12/1992 | Proctor et al. | 415/115 |
| 5,205,115 | 4/1993 | Plemmons et al. . | |
| 5,219,268 | 6/1993 | Johnson . | |

*Primary Examiner*—Edward K. Look
*Assistant Examiner*—Michael S. Lee

[57] ABSTRACT

A turbine shroud segment includes a substrate and a coating layer having varying thickness. Various construction details are developed that provide minimal spalling of the coating layer during use of the shroud segment. In a particular embodiment, a shroud segment includes a coating layer that tapers towards the edges. The thickness tapers to a minimum thickness along the leading and trailing edges. Within the blade passing region of the shroud segment, the coating layer tapers towards the lateral edges to a thickness determined by the minimum thickness required for abrasive contact between the shroud segment and rotor blades. In another particular embodiment, the varying thickness of the coating layer is produced by forming the substrate with a concave surface, applying the coating, and subsequently machining back the coating layer to the desired dimensions.

5 Claims, 3 Drawing Sheets fig.3
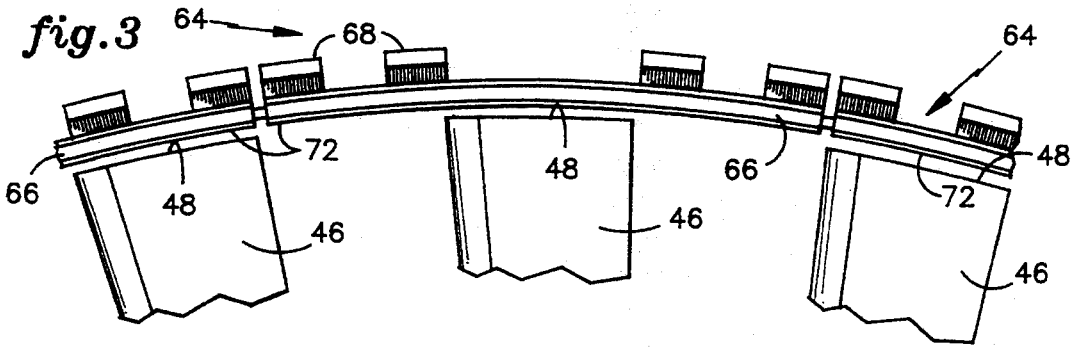
fig.4
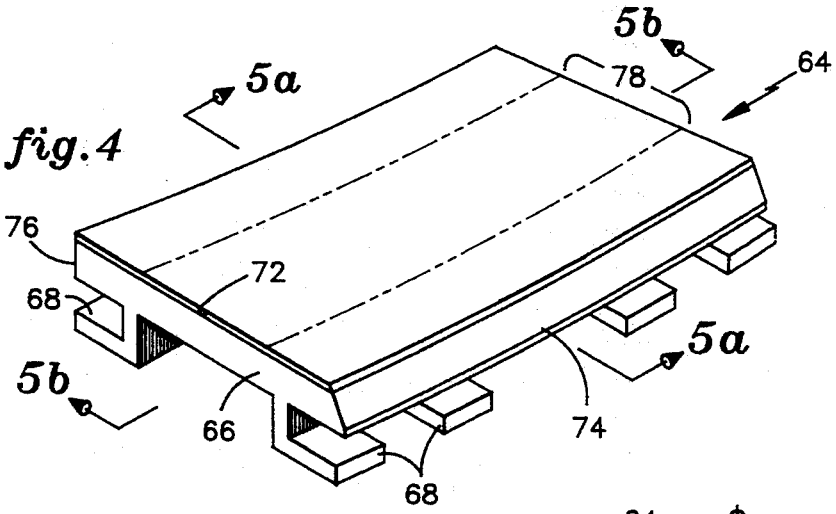
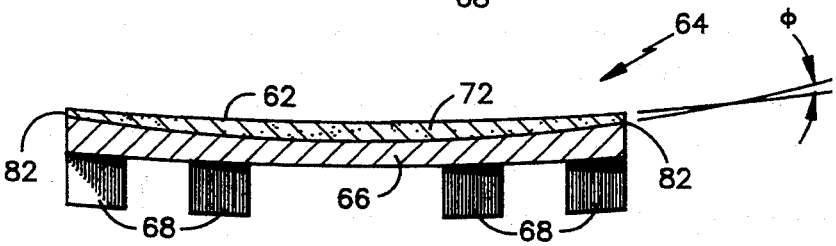
fig.5b
fig.6a
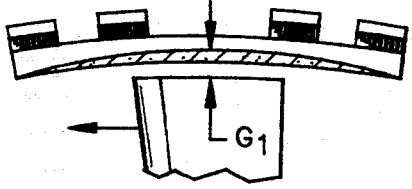
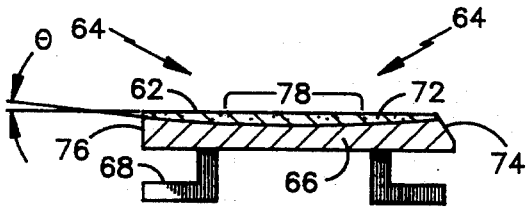
fig.5a
fig.6b
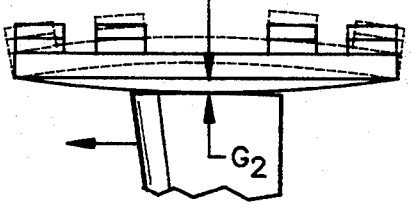

TURBINE SHROUD SEGMENT INCLUDING A COATING LAYER HAVING VARYING THICKNESS

TECHNICAL FIELD

This invention relates to elements having a substrate and a layer of a dissimilar material bonded to the substrate, and more specifically to such elements that are exposed to severe temperature gradients.

Although developed in the field of gas turbine engines, the invention has applications in other fields wherein elements having layers of dissimilar materials bonded together are used in environments causing thermal stresses to occur within the elements.

BACKGROUND OF THE INVENTION

Axial flow gas turbine engines include a compressor, a combustor, and a turbine spaced sequentially along a longitudinal axis. An annular flow path extends axially through the compressor, combustor and turbine. The compressor includes an array of rotating blades that engage incoming working fluid to compress the working fluid. A portion of the compressed working fluid enters the combustor where it is mixed with fuel and ignited. The products of combustion or hot gases then flow through the turbine. The turbine includes alternating arrays of vanes and rotating blades. In the turbine, energy is transferred from the flowing hot gases to the turbine blades. A portion of this energy is then transferred back to the compressor section via a rotor shaft.

To optimize the efficiency of the interaction between the turbine blades and the hot gases flowing through the turbine, the hot gases are confined to an annular space defined by inner and outer turbine shrouds. The inner turbine shroud is typically a plurality of platforms integral to the blades. The platforms mate with adjacent platforms to form an inner flow surface for the hot gases. The outer shroud is typically a ting-like assembly disposed radially outward of, but in close radial proximity to, the outer tips of the rotating blades. The assembly includes a plurality of arcuate segments spaced circumferentially to provide an outer flow surface for the hot gases.

The segments include a substrate and a coating layer defining a flow surface for the segment. The substrate includes the means to retain the segment to the turbine, typically a plurality of hooks or a rail disposed along the leading edge and trailing edge of the segment. The coating layer may be a thermal barrier coating and/or an abradable coating. The thermal barrier coating provides insulation for the segment against the hot gases flowing through the turbine. The abradable coating provides material for the tips of the blades to engage with during operation. The tips may be coated with a abrasive coating that cuts into the abradable coating to minimize the amount of hot gases which leak around the blades. The combination of abrasive tips and abradable coating prevent damage to the blades and substrate during contact. An example of such a segment is disclosed in U.S. Pat. No. 4,650,395, entitled "Coolable Seal Segment For a Rotary Machine" and issued to Weidner.

A common problem with segments of the type described above is spalling of the coating layer. Spalling refers to the coating layer detaching from the substrate. Spalling occurs as a result of thermal stresses within the segment. A thermal gradient exists across the segment due to the hot gases present on the coating side and a supply of cooling fluid flowing over the radially outer surface of the substrate. The differing rates of thermal expansion between the metal of the substrate and the material of the coating layer adds to the stresses present within the segment.

Spalling exposes the bare metal of the substrate to the hot gases and/or abrasive contact with the tip of the blade. Besides the potential degradation of the segment, spalling may also increase the size of the gap between the tips of the blades and the segments. Increases in the gap provides an opening for hot gases to flow around the blades and reduces the efficiency of the turbine.

The above art notwithstanding, scientists and engineers under the direction of Applicants' Assignee are working to develop turbine components, such as turbine shroud segments, capable of operating within extreme temperature environments for extensive periods of time with minimal degradation of the component.

DISCLOSURE OF THE INVENTION

According to the present invention, a turbine shroud segment includes a substrate and a coating layer that extends from an edge of the substrate inward, the coating layer having a thickness t that tapers toward the edge. A cross-section of the coating adjacent the edge forms an angle $\alpha$ being less than or equal to ten degrees.

The feature of tapering the coating layer thickness toward the edge results in minimal spalling of the coating layer from the substrate during use in the gas turbine engine and therefore a longer operational life for the turbine shroud segment may be obtained. The thinner coating layer near the edge reduces the thermal gradient in the coating layer along the edge, which is an area of frequent spalling. Reducing the thermal gradient in this area of the coating layer lowers the thermal stresses.

In a particular embodiment, the coating layer is an abradable material adapted to engage an abrasive tip of a rotor blade. The coating layer includes a blade passing region intermediate the leading edge and trailing edge of the turbine shroud segment. The blade passing region has a thickness $t_{bp}$ greater than or equal to a predetermined thickness to account for abrasive contact between the turbine shroud segment and the blade during operation. The point of maximum thickness occurs in this blade passing region and the coating layer thickness t tapers from the blade passing region towards the leading edge and trailing edge. Within the blade passing region, the thickness $t_{bp}$ tapers toward the lateral edges to a minimum thickness $t_{bp,min}$, wherein $t_{bp,min}$ is greater than or equal to the predetermined thickness.

The feature of tapering the coating layer thickness away from the blade passing region provides the advantage of minimizing spalling of the coating layer while permitting the coating layer within the blade passing region to be kept at a thickness greater than a predetermined minimum. In this way, the necessary amount of abradable material is present to engage the abrasive tips of the rotating blades.

The varying thickness of the coating layer may be accomplished in a variety of ways. For turbine shroud segments, a particularly useful method is to form the substrate with a concave mating surface and to apply the coating layer to the dimensions desired for the turbine shroud segments. The varying thickness of the coating layer is defined, at least in part, by the concave shape of the mating surface. A benefit of this configuration is that it provides additional clearance between the mating surface and the passing blade. During operation, the turbine shroud segment heats up and flexes inward toward the passing blade due to the temperature gradient of the segment and the thermal expansion differences between the coating material and the substrate material. This causes the segment to bow in the direction opposite of its normal arcuate shape and to bring the segment closer to the passing blade. With a concave mating surface, the blade passing region of the substrate is spaced an additional distance away from the blade tip at installation. The additional spacing permits the segment to flex inward with less risk of contact between the mating surface of the substrate and the blade tip.

Although developed in the field of gas turbine engines for the specific application of turbine shroud segments, it should be apparent to those skilled in the art that the invention disclosed herein is applicable to other applications. Any element having a substrate and a layer of a dissimilar material bonded to the substrate and which is exposed to a temperature gradient across the element may benefit from the invention. One such application is the liners or floatwall panels used in some gas turbine combustors. An example of liners is disclosed in U.S. Pat. No. 4,302,941, issued to DuBell and entitled "Combuster Liner Construction for Gas Turbine Engine". These liners are commonly coated with a thermal barrier coating to insulate the floating wall from the heat of combustion.

The foregoing and other objects, features and advantages of the present invention become more apparent in light of the following detailed description of the exemplary embodiments thereof, as illustrated in the accompanying drawings.

BRIEF DESCRIPTION OF THE DRAWINGS

FIG. 3 is an axial view of adjacent shroud segments and adjacent rotor blades, with the surrounding stator structure removed for clarity.

FIG. 4 is a perspective view of the shroud segment.

FIGS. 5*a* and 5*b* are sectional views taken along lines 5*a*—5*a* and 5*b*—5*b* of FIG. 4.

FIGS. 6*a* and 6*b* are illustrations of the effects of thermal distortion on the shroud segments during operation of the gas turbine engine. FIG. 6*a* illustrates the installed condition of the segment and FIG. 6*b* illustrates the distorted, operational condition.

BEST MODE FOR CARRYING OUT THE INVENTION

Figure 1:
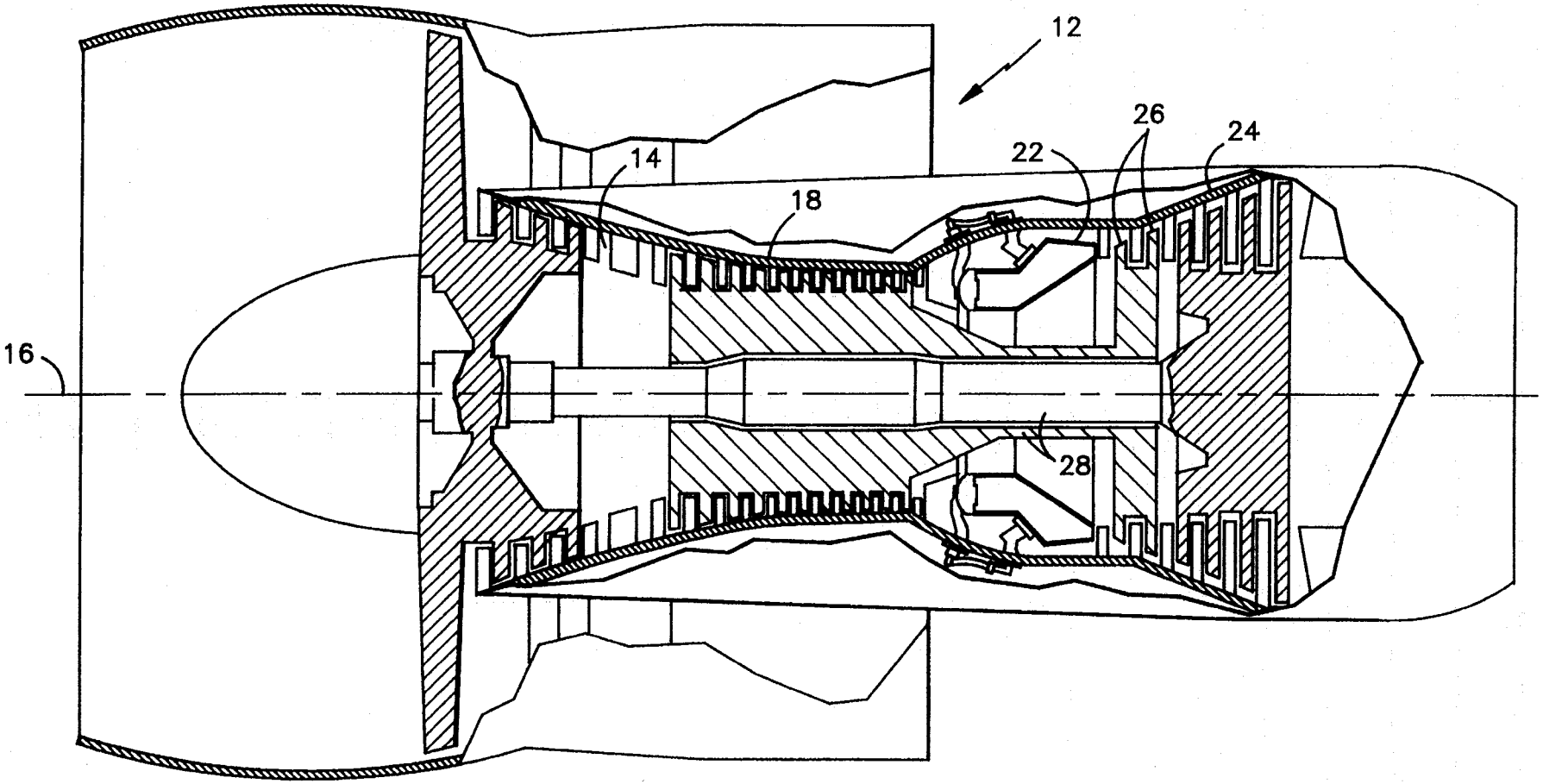
FIG. 1 is a cross-sectioned side view of an axial flow gas turbine engine.

A gas turbine engine 12 is illustrated in FIG. 1. The gas turbine engine 12 includes an annular flow path 14 disposed about a longitudinal axis 16. A compressor 18, combustor 22 and turbine 24 are spaced along the axis with the flow path 14 extending sequentially through each of them. The turbine 24 includes a plurality of rotor assemblies 26 that engage working fluid flowing through the flow path 14 to transfer energy from the flowing working fluid to the rotor assemblies 26. A portion of this energy is transferred back to the compressor 18, via a pair of rotating shafts 28 interconnecting the turbine 24 and compressor 18, to provide energy to compress working fluid entering the compressor 18.

Figure 2:
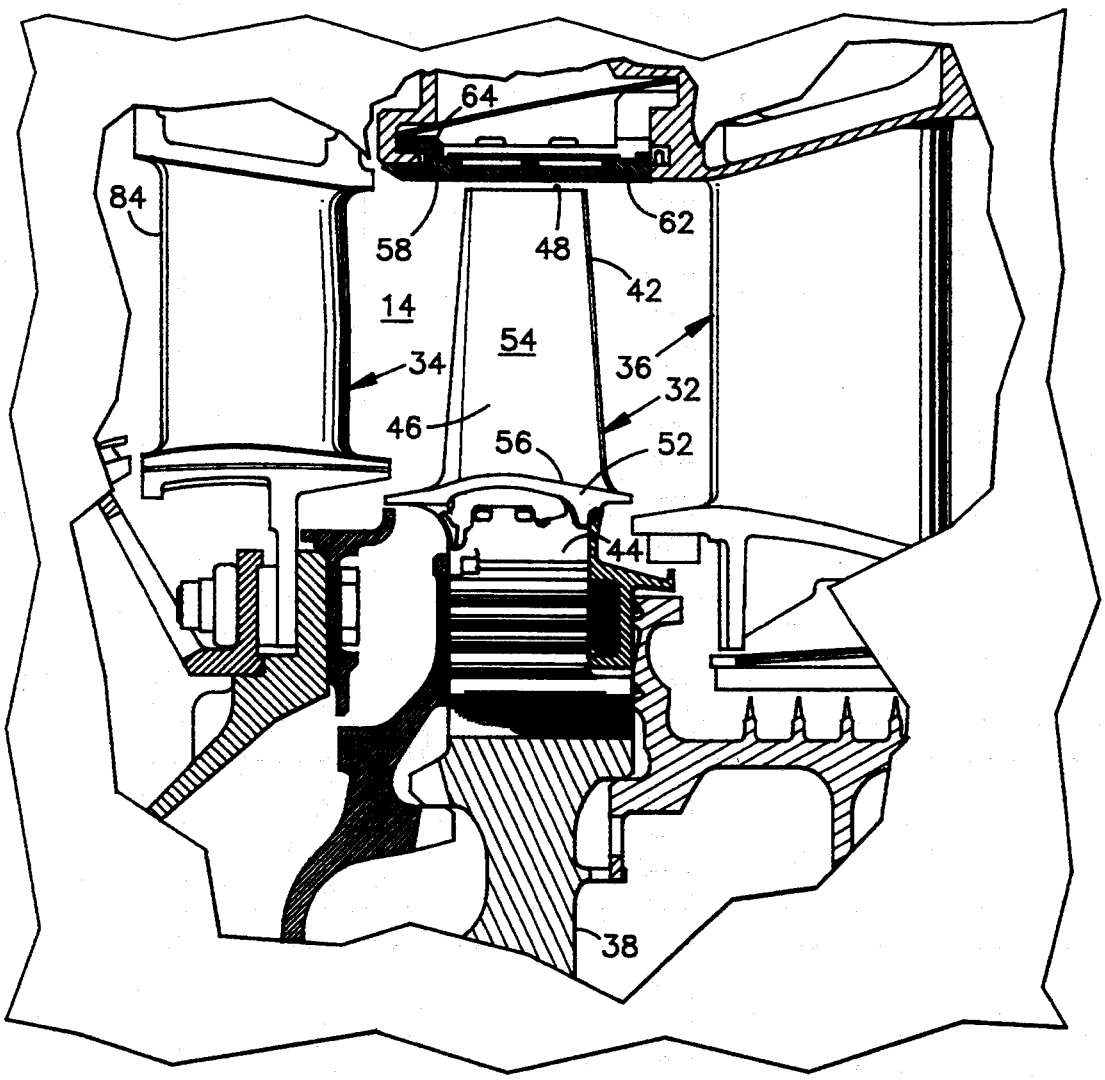
FIG. 2 is side view, partially sectioned, of a turbine rotor assembly and turbine stator structure including a shroud segment.

Referring now to FIG. 2, a rotor assembly 32 is axially positioned between an upstream vane assembly 34 and a downstream vane assembly 36. The rotor assembly 32 includes a rotating disk 38 having a plurality of rotor blades 42 extending radially therefrom. Each of the rotating blades 42 includes a root portion 44, an airfoil portion 46 having a tip 48, and an inner platform 52. The root portion 44 retains the blade 42 to the disk 38 during rotation of the rotor assembly 32. The airfoil portion 46 extends radially through the flow path 14 and provides a flow surface 54 to engage the working fluid flowing through the turbine 24. The inner platform 52 extends laterally from the blade 42 and mates with the platforms of circumferentially adjacent blades to define a radially inner flow surface 56. The radially inner flow surface 56 urges the flowing working fluid to over the flow surface 54 of the airfoil portion 46.

A turbine shroud 58 extends circumferentially about and radially outward of the rotor assembly 32. The tips 48 of the rotating blades 42 are in close radial proximity to a radially outer flow surface 62 defined by the turbine shroud 58. The flow surface 62 discourages the working fluid from flowing radially outward and urges the working fluid to flow over the flow surface 54 of the airfoil portion 46. The flow surface 62 of the turbine shroud 58 and the flow surface 56 of the platforms 52 in conjunction confine the working fluid into an annular passage through which the blades 42 extend to optimize engagement between the working fluid and rotating blades 42.

The turbine shroud 58 includes a plurality of shroud segments 64 spaced circumferentially about the flow path 14. As shown in FIG. 4, each shroud segment 64 is arcuately shaped and includes a substrate 66 having a plurality of hooks 68 and a coating layer 72. The hooks 68 provide means to retain the shroud segment 64 to the adjacent structure of the turbine shroud 58. The turbine shroud 58 also includes means to flow cooling fluid onto the outward surfaces of the segments 64. The cooling fluid maintains the substrates 66 within acceptable temperature limits for the materials from which the substrates 66 are formed.

The coating layer 72 extends over the radially inward facing surface, or mating surface, of the substrate 66 and therefore faces inward towards the flow path 14. As such, the coating layer 72 defines the flow surface 62 for the turbine shroud 58 and is directly exposed to the hot gases flowing within the turbine 24. As shown in FIGS. 5*a* and 5*b*, the coating layer 72 has a thickness t, measured outward from the mating surface of the substrate 66, that tapers toward the edges of the segment 64. Along the leading edge 74 and trailing edge 76 of the segment 64, the coating layer 72 has a minimum thickness t and gradually increases in thickness towards the blade passing region 78 of the segment 64. A cross section of the coating layer 72 along the leading and trailing edges 74, 76 forms an angle 0. Along the lateral edges 82 of the segment 64, and within the blade passing region 78 of the coating layer 72, the coating layer 72 gradually increases in thickness t from a predetermined minimum thickness $t_{bp,min}$ for the blade passing region 78 to a maximum intermediate the lateral edges 82. A cross section of the coating layer along the lateral edges forms an angle $\phi$.

The coating layer 72 is a combination of a thermal barrier coating and an abradable coating. The thermal barrier coating insulates the inner or mating surface of the substrate 66 from the hot gases in the flow path 14. The abradable coating is located in the region of the blade passing region 78 of the flow surface 62 to engage the blade tip 48, which is coated with an abrasive material. The coating layer may also require a bonding layer to provide means to adhere the thermal barrier coating and abradable coating.

During operation, the blade tips 48 will initially pass in close proximity to the coating layer 72. As the engine 12 heats up, the heat from the hot gases flowing by the segments 64 will cause the segments 64 to heat up. A thermal gradient will result from the segments having a 'hot side', i.e. the flow surface 62 side, and a 'cold side', i.e. the outward side of the segment 64 that is exposed to direct contact with the cooling fluid. The thermal gradient, in addition to the different thermal expansion coefficients of the substrate 66 and coating layer 72 materials, cause the segments 64 to distort. This thermal distortion results in the normally arcuate segment 64 flattening out such that the flow surface 62 of the segments 64 moves radially inward toward the rotating blades 42. As shown in FIG. 3, the passing blade tips 48 may engage the shroud segment 64 causing the abrasive tip 48 to make contact with the coating layer 72. This type of abrasive contact between the abrasive tip 48 and the abradable coating layer 72 defines a sealing mechanism to prevent working fluid from leaking around the tips of the blade 48. Such leakage fluid would not engage the airfoil 46 of the blade and reduce the efficiency of the turbine.

The thermal gradient also produces thermal stresses within the segment 64, particularly between the substrate 66 and the coating layer 72. These thermal stresses cause the segment 64 to be susceptible to spalling, especially in the region of the edges and corners. Once spalling occurs, the substrate 66 material is exposed to the hot gases and subject to the degrading effects of such exposure. In addition, the loss of coating layer 72 may increase the gap G between the tips 48 of the passing blades 42 and the flow surface 62. The larger gap permits more flow to escape around the airfoil 46 of the blade 42.

By minimizing the thickness t of the coating layer 72 in regions most susceptible to spalling, the thermal gradient is minimized and, as a result, the thermal stresses are minimized in those regions. The resulting lower stresses reduce the likelihood of the coating layer 72 becoming detached from the substrate 66. Additionally, minimizing the thickness t of the coating layer 72 near the edges 74, 76, 82 minimizes the size of the resulting gap G even if spalling were to occur. The angles $\theta$ and $\phi$ (see FIGS. 5*a* and 5*b*) depend upon the thermal environment of the segment, the size of the blade passing region, and the minimum thickness permissible for the coating. As mentioned previously, the coating layer thickness is minimal near the edges. To get the coating layer material to adhere to the substrate however, a minimum thickness of coating layer material may be required to account for the bonding layer. In addition, in the blade passing region the thickness of the coating layer may not be less than a thickness $t_{bp,\,min}$. The thermal environment of a typical first stage turbine shroud segment results in a thermal gradient along the order of 1000° F. For thermal gradients of this magnitude, the thickness of the coating layer near the edges should be as thin as possible. It is suggested by the Applicants, based upon tests performed on test samples, that for best results the angles $\theta$ and $\phi$ should be kept at less than or equal to ten (10) degrees.

Although minimizing the coating layer 72 thickness t near the edges 74, 76, 82 may reduce the insulation benefits of the coating layer 76 in those regions, the increase in temperature of the segment 64 is not a significant detriment. Referring to FIG. 2, along the leading edge 74, cooling fluid that escapes around the segment 64 and the upstream vane 84 flows radially inward into the flow path 14 since this cooling fluid is selected to be at a higher pressure than the flow path fluid. The escaping cooling fluid then flows over the leading edge 74 of the segment 64 to help maintain the temperature of this region. The trailing edge 76 is exposed to flow path fluid that has passed through the rotor assembly 32. Upon passing through the rotor assembly 32, the working fluid has transferred some energy to the rotor assembly 32 and is at a lower temperature. Therefore, less insulation is required along the trailing edge 76 of the segment 64. As discussed previously, the lateral edges within the blade passing region are maintained above a minimum thickness $t_{bp,min}$ required for the abrasive contact between the blade tips 48 and coating layer 72. The additional material provides the necessary insulation for the lateral edges 82.

The varying thickness of the coating layer 72 may be accomplished in a variety of ways. One method is to apply a uniform amount of the coating layer 72 material to the mating surface of the substrate 66 and then to machine back the coating layer 72 to the desired taper. Another method is to form the mating surface to be concave and to apply the coating layer 72 material to bring the surface of the coating layer 72 up to desired thickness and shape. A third method is to combine the above two methods. In this method, the mating surface is formed to be concave, the coating layer is uniformly applied to the mating surface, and then the coating layer is machined back to the desired shape and taper.

For turbine shroud segments 64, forming the substrate 66 with a concave mating surface, applying the coating layer 72, and machining the coating layer 72 to the dimensions desired for the turbine shroud segments 64 is suggested. The varying thickness of the coating layer 72 is defined, in part, by the concave shape of the mating surface. As shown in FIGS. 6*a* and 6*b*, a benefit of this configuration is that is provides clearance $G_1$ between the mating surface and the passing blade 42. The clearance $G_1$ is greater than the clearance associated with a similarly positioned segment having a flat mating surface and a convex coating layer to produce the varying thickness desired. As discussed previously, during operation, the turbine shroud 58 flexes inward toward the passing blade 42. This causes the segment to bow in the direction opposite of its normal arcuate shape and to bring the segment closer to the passing blade 42, such that the clearance reduces to $G_2$. With a concave mating surface, the blade passing region 78 of the mating surface remains spaced away from the blade tip 48 at installation. The spacing permits the segment 64 to flex inward with less risk of contact between the mating surface of the substrate 66 and the blade tip 48.

In addition, having a concave mating surface to provide the varying thickness of the coating layer 73 may be used to produce an element having a flow surface without a step, even a gradual one. This feature may be used in applications other than turbine shroud segments wherein an element having a flow surface and formed of two dissimilar materials is exposed to a temperature gradient that results in thermal stresses in the element. It may be desirable to avoid the gradual step required if a tapered coating was applied directly to a planar mating surface. One such possible application is the floatwall panels of some gas turbine engine combustors.

Although the invention has been shown and described with respect to exemplary embodiments thereof, it should be understood by those skilled in the art that various changes, omissions, and additions may be made thereto, without departing from the spirit and scope of the invention.

What is claimed is:

1. A turbine shroud segment including a substrate formed from a first material and a coating layer formed from a second material, the substrate having a quadrilateral-shaped mating surface extending in two directions and having (an) four edges, the coating layer having a thickness t and being bonded to the mating surface, the coating layer extending over the mating surface to all four edges (from the edge inward), wherein the thickness of the coating layer tapers inward from all four edges such that a point of maximum coating thickness occurs inward of all four edges and (toward the edge) such that a cross-section of the coating layer forms an angle, and wherein the angle is less than or equal to ten degrees.

2. The turbine shroud segment according to claim 1, wherein the mating surface is planar, wherein the coating layer includes a flow surface facing outward from the turbine shroud, and wherein the flow surface is convex.

3. The turbine shroud segment according to claim 1, wherein the coating layer is formed from an abradable material adapted to engage an abrasive tip of a rotor blade, wherein the coating layer includes a blade passing portion located inward from the edge, the blade passing portion having a minimum thickness $t_{bp}$, and wherein the coating layer thickness tapers from the blade passing portion to the edge.

4. A method of forming an element for use within an environment producing a thermal gradient across the element, the element including a substrate having a mating surface extending toward an edge and formed of one material, and a coating layer disposed over the mating surface and formed of a second material, the two materials having different coefficients of thermal expansion such that the element distorts upon exposure to the thermal gradient, wherein the method including steps of:

forming the mating surface to have a concave surface; (and)

applying the second material over the mating surface such that the coating layer has a varying thickness, the thickness of the coating layer increasing away from the edge;

applying the second material in a uniform thickness over the mating surface; and machining the second material to the desired thickness.

5. A turbine shroud segment including a substrate formed from a first material and a coating layer formed from a second material, the substrate having a concave-shaped mating surface extending in two directions and having an edge, the coating layer having a thickness t and being bonded to the mating surface, the coating layer extending from the edge inward, wherein the thickness of the coating layer tapers toward the edge such that a cross-section of the coating layer forms an angle, and wherein the angle is less than or equal to ten degrees, and wherein the coating layer includes a flow surface facing outward from the turbine shroud, and wherein the flow surface is planar.

* * * * *